US009279612B2

(12) United States Patent
Bulijina et al.

(10) Patent No.: US 9,279,612 B2
(45) Date of Patent: Mar. 8, 2016

(54) COOLER

(71) Applicants: Irhad Bulijina, Oberhausen (DE); Thomas Greven, Neuss (DE); Stephan Faulhaber, Dortmund (DE)

(72) Inventors: Irhad Bulijina, Oberhausen (DE); Thomas Greven, Neuss (DE); Stephan Faulhaber, Dortmund (DE)

(73) Assignee: MAN Diesel & Turbo SE, Augsburg (DE)

( * ) Notice: Subject to any disclaimer, the term of this patent is extended or adjusted under 35 U.S.C. 154(b) by 155 days.

(21) Appl. No.: 14/158,576

(22) Filed: Jan. 17, 2014

(65) Prior Publication Data

US 2014/0202198 A1 Jul. 24, 2014

(30) Foreign Application Priority Data

Jan. 18, 2013 (DE) ..... 10 2013 000 766

(51) Int. Cl.

| | |
|---|---|
| ***F25D 31/00*** | (2006.01) |
| ***F28F 9/00*** | (2006.01) |
| ***F28F 13/06*** | (2006.01) |
| ***F28D 7/16*** | (2006.01) |
| *F28F 9/22* | (2006.01) |

(52) U.S. Cl.

CPC *F25D 31/00* (2013.01); *F28D 7/16* (2013.01); *F28F 9/005* (2013.01); *F28F 13/06* (2013.01); *F28F 2009/222* (2013.01)

(58) Field of Classification Search

CPC ..... F25D 31/00; F25D 7/16; F28F 9/005; F28F 13/06; F28F 2009/222

USPC ..... 62/440; 165/111, 160

See application file for complete search history.

(56) References Cited

U.S. PATENT DOCUMENTS

| | | | | |
|---|---|---|---|---|
| 3,191,630 | A | 6/1965 | Demyan | |
| 4,254,825 | A * | 3/1981 | Imazu | 165/114 |
| 4,550,775 | A * | 11/1985 | Edwards et al. | 165/111 |
| 5,000,255 | A * | 3/1991 | Pflum | 165/104.16 |
| 6,095,238 | A * | 8/2000 | Kawano et al. | 165/113 |
| 7,490,595 | B2 | 2/2009 | Brück et al. | |
| 8,743,542 | B2 * | 6/2014 | Kok et al. | 361/696 |
| 2002/0038701 | A1 * | 4/2002 | Saito et al. | 165/153 |
| 2005/0089731 | A1 * | 4/2005 | Ogiwara et al. | 429/19 |
| 2005/0284157 | A1 * | 12/2005 | Fijas et al. | 62/93 |
| 2006/0057059 | A1 * | 3/2006 | Nishida et al. | 423/648.1 |
| 2009/0158742 | A1 * | 6/2009 | Farhangi et al. | 60/737 |

(Continued)

FOREIGN PATENT DOCUMENTS

| | | |
|---|---|---|
| DE | 40 34 928 | 5/1992 |
| DE | 10 2005 014 264 | 9/2006 |
| EP | 2 159 394 | 3/2010 |
| FR | 984 248 | 7/1951 |
| JP | S 50-40901 | 4/1975 |

(Continued)

*Primary Examiner* — Mohammad M Ali
(74) *Attorney, Agent, or Firm* — Cozen O'Connor

(57) ABSTRACT

A cooler for cooling a gaseous medium includes: a housing; a heat exchanger in the housing, the heat exchanger having an inlet portion at a flow inlet side of the heat exchanger, an outlet portion arranged at a flow outlet side of the heat exchanger, and tubes through which a coolant flows and about which gaseous medium to be cooled circulates; at least one inflow, through which the medium to be cooled can be introduced into the housing and fed to the inlet portion of the heat exchanger; at least one drain, through which cooled medium originating from the outlet portion of the heat exchanger can be discharged out of the housing; and at least one perforated plate-like flow homogenization element positioned in the housing at a position upstream of the inlet portion of the heat exchanger, seen in a flow direction of the medium to be cooled.

10 Claims, 3 Drawing Sheets

(56) References Cited

U.S. PATENT DOCUMENTS

| | | | | |
|---|---|---|---|---|
| 2010/0095939 | A1 | 4/2010 | Geskes | |
| 2011/0283736 | A1* | 11/2011 | Manabe et al. | 62/476 |

FOREIGN PATENT DOCUMENTS

| | | |
|---|---|---|
| JP | S 56-140073 | 10/1981 |
| JP | 2010-133678 | 6/2010 |

* cited by examiner

COOLER

BACKGROUND OF THE INVENTION

1. Field of the Invention

The present invention relates to a cooler for cooling a gaseous medium that is compressed in a compressor.

2. Description of the Related Art

It is known to cool a gaseous medium that has been compressed in a compressor using a cooler. Such a cooler can be an intercooler arranged between two compressor stages or a recooler arrangement after the last or only compressor stage.

Known coolers for cooling a gaseous medium compressed in a compressor comprise a housing, wherein in the housing a heat exchanger for cooling the compressed, gaseous medium is arranged. Such a cooler comprises a plurality of tubes through which coolant flows and about which the gaseous medium to be cooled circulates.

The coolant is typically water and the gaseous medium to be cooled is typically air.

The housing of the cooler comprises at least one inflow, via which the gaseous medium to be cooled can be introduced into the housing of the cooler and fed to a portion of the heat exchanger on the flow inlet side. Furthermore, the housing comprises at least one outflow, via which cooled, gaseous medium starting out from a portion of the heat exchanger on the flow outlet side can be discharged out of the housing of the cooler.

Depending on the area of application, such a cooler can have large dimensions. Thus, coolers are known, the housing of which has a length of more than 10 meters and a diameter of more than 3 meters. In the case of coolers having such large dimensions there is the problem that a non-uniform flow for the gaseous medium to be cooled forms within the cooler. Such a non-uniform flow for the gaseous medium to be cooled is disadvantageous since the cooler in this situation cannot be optimally operated. A non-uniform flow of the compressed gaseous medium to be cooled through the cooler restricts the cooling capacity of the cooler.

SUMMARY OF THE INVENTION

In consideration of these problems, an object of the present invention is based on creating a new type of cooler.

According to one aspect of the invention, at least one perforated, plate-like flow homogenization element is positioned in the housing seen in flow direction of the medium to be cooled upstream of the portion of the heat exchanger on the flow inlet side.

According to an aspect of the present invention, at least one perforated, plate-like flow homogenization element is positioned upstream of the portion of the heat exchanger on the flow inlet side. By way of the, or each, flow homogenization element, a uniform flow for the gaseous medium to be cooled through the heat exchanger of the cooler can be realized. The cooler can then be operated at an optimal operating point, as a result of which its cooling capacity can be improved. Furthermore, condensate separation of a condensate separator of the cooler that may be present can also be improved with the invention. Furthermore, the pressure loss in a cooler can be reduced with the invention and the vibration loading of components of the cooler reduced.

According to an advantageous further development, in another aspect, at least one perforated plate-like flow homogenization element, which seen in flow direction of the medium to be cooled is positioned upstream of the portion of the heat exchanger on the flow inlet side, is subdivided into a plurality of segments of different porosity. By way of the segments with different porosities, an optimal through-flow of the cooler or the heat exchanger of the cooler with the gaseous medium to be cooled can be adjusted.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are explained in more detail with the help of the drawings without being restricted thereby. In the drawings.

DETAILED DESCRIPTION OF THE PRESENTLY PREFERRED EMBODIMENTS

The present invention relates to a cooler that serves to cool a gaseous medium compressed in a compressor. The compressor can be an axial compressor and the cooler, according to exemplary embodiments of the invention, can be an intercooler or recooler. In particular, the exemplary embodiments of the invention relate to such coolers as are employed in large compressor plants from a capacity of approximately 300,000 $Nm^3/h$.

Figure 1:
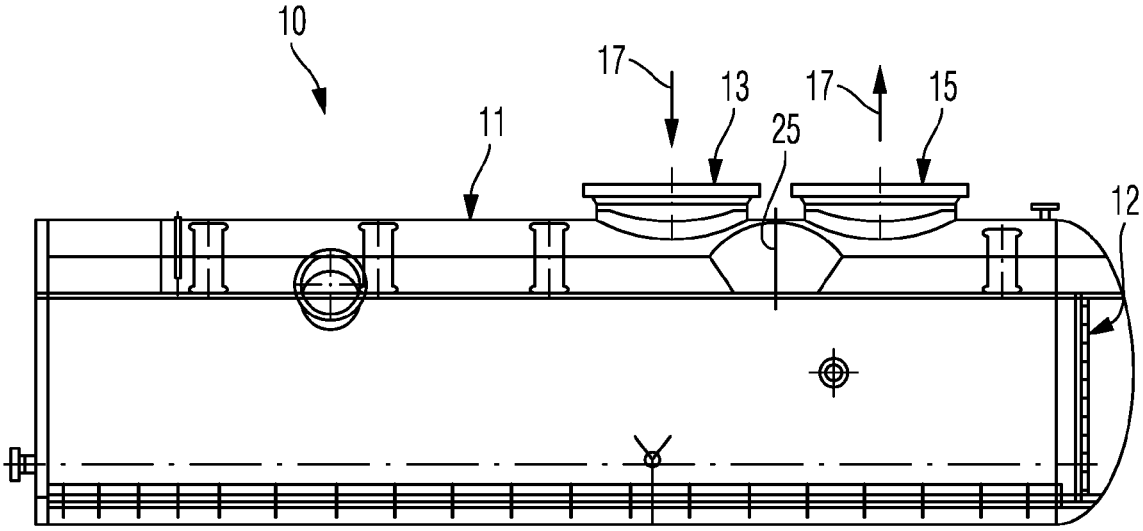
FIG. 1: is a lateral view of a cooler in accordance with one embodiment.
Figure 2:
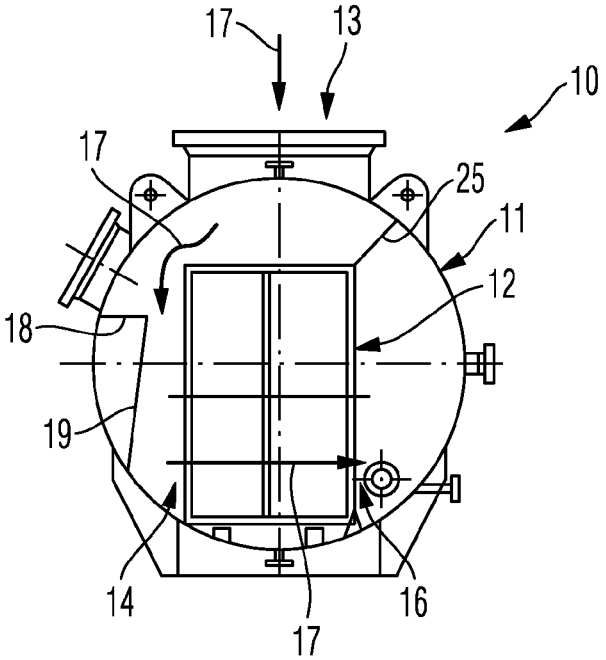
FIG. 2: is a front view of the cooler.

FIGS. 1 and 2 show different view of a cooler 10, namely a housing 11 of the cooler 10, wherein within the housing 10 a heat exchanger 12 is arranged.

The heat exchanger 12 comprises a plurality of tubes, which are not shown in detail, through which a coolant, in particular water, flows and about which the gaseous medium to be cooled, in particular air to be cooled, circulates.

On the housing 11 of the cooler 10 at least one inflow 13 is formed, via which the compressed gaseous medium to be cooled can be introduced into the housing 11 of the cooler 10 and fed to a portion 14 of the heat exchanger 12 on the flow inlet side. Furthermore, the housing 11 comprises at least one drain 15, via which cooled medium, starting out from a portion 16 of the heat exchanger 12 on the flow outlet side can be discharged out of the housing 11 of the cooler 10. The flow of the gaseous medium yet to be cooled and the flow of the already cooled gaseous medium are separated from one another via at least one separating plate 25.

Figure 3:
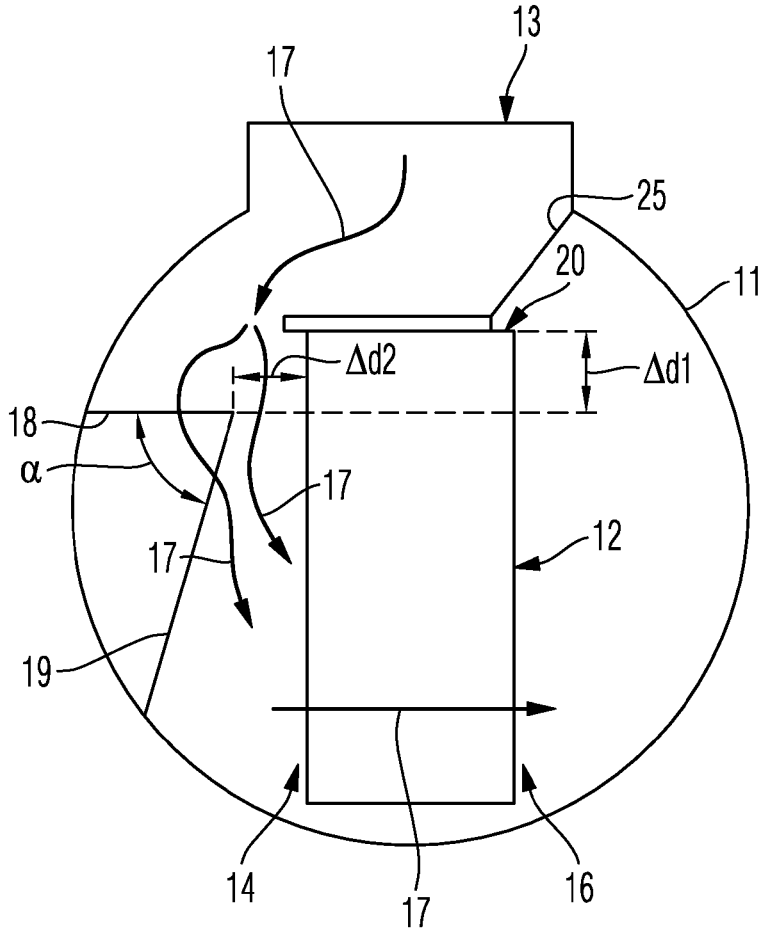
FIG. 3: is a cross section through the cooler.
Figure 5:
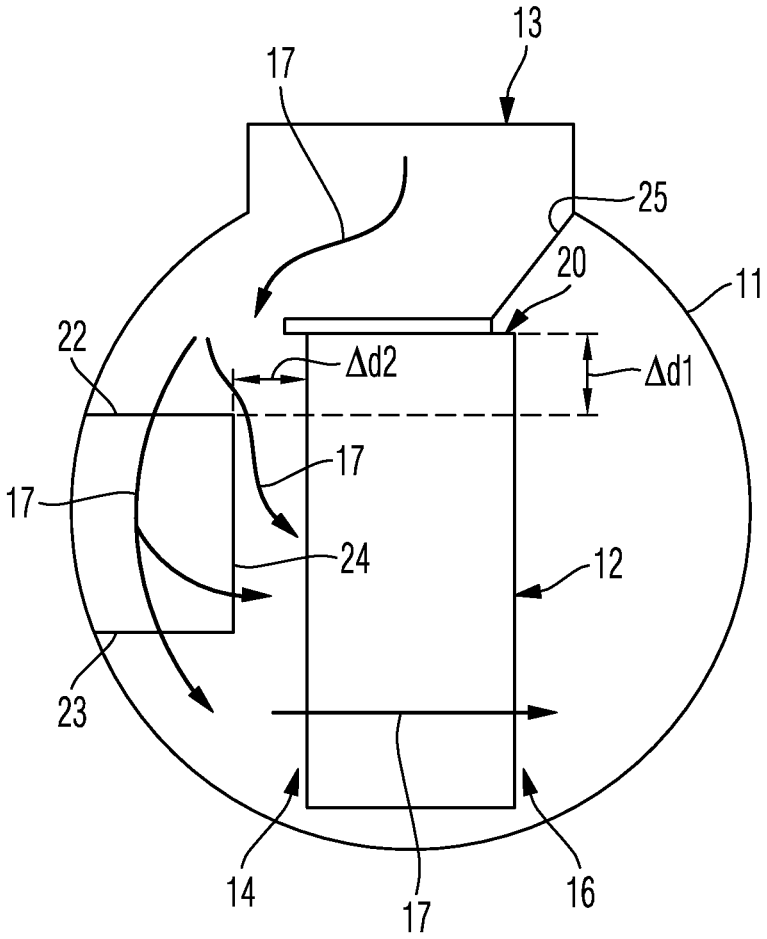
FIG. 5: is a cross section through a cooler in accordance with another embodiment.

In the figures, the flow direction of the gaseous medium to be cooled through the cooler 10 is shown by arrows 17, wherein in particular FIGS. 2, 3 and 5 show that the gaseous medium to be cooled flows into the cooler 10 via the inflow 13 from above, is subsequently vertically and horizontally distributed along the portion 14 of the heat exchanger 12 on the flow inlet side, then flows through the heat exchanger 12 in horizontal direction from the portion 14 on the flow inlet side to the portion 16 on the flow outlet side, and then flows vertically and horizontally along the portion 16 of the heat exchanger 12 on the flow outlet side to the drain 15.

In accordance with disclosed embodiments of the present invention, at least one perforated, plate-like flow homogenization element is positioned in the housing 11 of the cooler 10 seen in a flow direction of the gaseous medium to be cooled upstream of the portion 14 of the heat exchanger 12 on the flow inlet side.

In the exemplary embodiment of FIGS. 1 to 4, two perforated, plate-like flow homogenization elements 18, 19 are positioned seen in flow direction of the gaseous medium to be cooled in front of the portion 14 of the heat exchanger 12 on the flow inlet side, which, according to FIG. 3, are arranged at an angle profile to one another and include an angle $\alpha$ between 30° and 60°. Preferentially, the two perforated, plate-like flow homogenization elements 18 and 19 include an angle $\alpha$ between 40° and 50°. A first perforated, plate-like flow homogenization element 18 extends in or parallel to the flow direction 17 of the medium to be cooled through the heat exchanger 12. A second flow homogenization element 19, which is arranged below the first flow homogenization element 18, extends at an incline to the flow direction 17 of the medium to be cooled through the heat exchanger 12.

Preferentially, both the first, upper plate-like flow homogenization element 18 as well as the second, lower plate-like flow homogenization element 19 is subdivided into a plurality of segments of different porosity.

The segments of different porosity of the upper flow homogenization element 18, which runs in or parallel to the flow direction 17 of the medium to be cooled through the heat exchanger 12, are positioned next to one another preferentially in such a manner in horizontal direction perpendicularly to the flow direction 17 of the medium to be cooled through the heat exchanger, that segments adjacent to the inflow 13 for the medium to be cooled have a relatively low porosity and, with increasing spacing from the inflow 13, have a relatively high porosity. Thus it can be provided to subdivide the upper flow homogenization element 18 into for example five or seven segments, wherein the segment which is positioned adjacent to the inflow 13, has a relatively low porosity of, for example, 40%, whereas with increasing spacing of the segments from the inflow 13 the porosity gradually increases, for example in steps of 10% for each segment.

Preferentially, the lower flow homogenization element 19, which with respect to the flow direction 17 of the medium to be cooled through the heat exchanger 12 is set at an incline, is also subdivided into a plurality of segments of different porosity, wherein in an exemplary embodiment it can be provided to subdivide this flow homogenization element 19 into two segments, such that an upper segment of the lower flow homogenization element 19, which runs adjacent to the upper flow homogenization element 18, exhibits a relatively high porosity, whereas the lower segment of the lower flow homogenization element 19, which is spaced from the upper flow homogenization element 18, exhibits a relatively low porosity. The segments of different porosity of the lower flow homogenization element 19 in this embodiment are consequently not positioned in horizontal direction next to one another but in vertical direction on top of one another.

As is best evident from FIG. 3, the upper, first flow homogenization element 18, which extends parallel to the flow direction 17 of the medium to be cooled through the heat exchanger 12, is arranged with a spacing $\Delta d1$ below an upper edge 20 of the heat exchanger 12. It is further evident from FIG. 3 that both flow homogenization elements 18 and 19 are arranged with a spacing $\Delta d2$ in front of the portion 14 of the heat exchanger 12 on the flow inlet side, so that, accordingly, a part of the flow to be directed via the heat exchanger 12 is directed via the flow homogenization elements 18 and 19 and another part past the latter.

Figure 4:
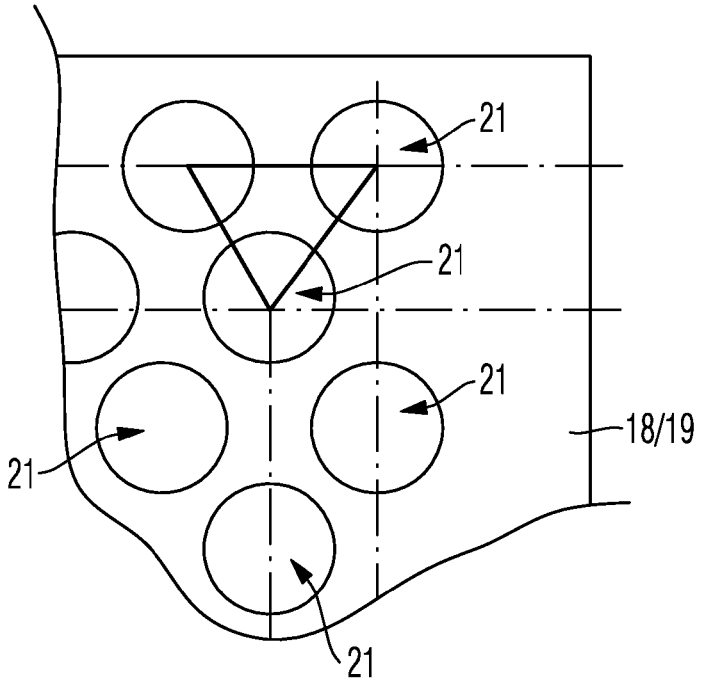
FIG. 4: is a detail of the cooler.

FIG. 4 shows a detail from the flow homogenization element 18 or from the flow homogenization element 19 in the region of a segment of the same, in which in FIG. 4 a plurality of holes or recesses 21 are shown, the size and spacing of which determine the porosity of the respective segment of the respective flow homogenization element 18 and 19 respectively.

In FIG. 4, the recesses 21 are arranged matrix-like in the form of a plurality of rows and columns, wherein in the middle between two recesses 21 of a first row a recess of an adjacent second row is arranged. Three recesses 21, each positioned in two rows, are arranged with their center points on the corner points of an isosceles triangle. This arrangement of the recesses 21 is purely exemplary in nature.

FIG. 5 shows an alternative exemplary embodiment of a cooler 10 according to the invention, in which in the housing 11 three perforated, plate-like flow homogenization elements 22, 23 and 24 are positioned. A first, upper flow homogenization element 22 and a second, lower flow homogenization element 24 each extend in or parallel to the flow direction 17 of the gaseous medium to be cooled through the heat exchanger 12. A third, middle flow homogenization element 24 extends perpendicularly to the flow direction of the gaseous medium to be cooled through the heat exchanger 12 between the upper flow homogenization element 22 and the lower flow homogenization element 23. At least one of these flow homogenization elements 22, 23, 24 can be again subdivided into a plurality of segments of different porosity each.

With the invention it is possible in a simple way to bring about a flow homogenization within the cooler 10 in order to thereby ensure that the gaseous medium to be cooled is uniformly or evenly conducted via the heat exchanger 12 of the cooler 10. Because of this, the efficiency of the cooler 10 can be improved and the latter operated in an optimal operating point. By homogenizing the flow through the cooler 10 assemblies of the latter are additionally subjected to less vibration. The pressure loss in the cooler 10 can be optimised. Furthermore, a condensate separation if appropriate can be improved on a condensate separator that is installed upstream of the heat exchanger 12.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cooler (10) for cooling a gaseous medium compressed in a compressor, the cooler comprising:

a housing (11);

a heat exchanger (12) positioned in the housing (11), the heat exchanger (12) having an inlet portion (14)

arranged at a flow inlet side of the heat exchanger (12), an outlet portion (16) arranged at a flow outlet side of the heat exchanger (12), and a plurality of tubes, through which plurality of tubes a coolant flows and about which plurality of tubes gaseous medium to be cooled circulates;

at least one inflow (13), through which at least one inflow (13) the medium to be cooled can be introduced into the housing (11) and fed to the inlet portion (14) of the heat exchanger (12);

at least one drain (15), through which at least one drain (15) cooled medium originating from the outlet portion (16) of the heat exchanger (12) can be discharged out of the housing (11); and a plurality of plate-like flow homogenization elements (18, 19) positioned in the housing (11) at a position upstream of the inlet portion (14) of the heat exchanger (12), seen in a flow direction of the medium to be cooled, wherein in the housing (11) at least two of the plurality of perforated, plate-like flow homogenization elements (18, 19) are positioned at an angle profile to one another such that a first, upper one of the plurality of flow homogenization elements (18) extends in the flow direction of the medium to be cooled through the heat exchanger (12), and a second, lower one of the plurality of flow homogenization elements (19) extends at an incline to the flow direction of the medium to be cooled through the heat exchanger (12).

2. The cooler according to claim 1, wherein the plurality of perforated, plate-like flow homogenization elements (18, 19) is subdivided into a plurality of segments of different porosity.

3. The cooler according to claim 1, wherein the first, upper flow homogenization element (18) and the second, lower flow homogenization element (19) are positioned with respect to one another at an angle of between 30° and 60°.

4. The cooler according to claim 3, wherein the first, upper flow homogenization element (18) and the second, lower flow homogenization element (19) are positioned with respect to one another at angle of between 40° and 50°.

5. The cooler according to claim 4, wherein the first, upper flow homogenization element (18) is arranged below an upper edge (20) of the heat exchanger (12) at a first spacing and the first, upper flow homogenization element (18) and the second, lower flow homogenization element (19) are each arranged at a second spacing from the inlet portion (14) of the heat exchanger (12).

6. The cooler according to claim 5, wherein the first, upper flow homogenization element (18) is subdivided into a plurality of segments of different porosity, wherein the segments of different porosity are positioned next to one another such that segments that are adjacent to the, or each, inflow (13) for the medium to be cooled have a relatively low porosity and segments that are distal to the, or each, inflow (13) have an relatively high porosity, the porosity increasing with increased distance from the, or each, inflow (13).

7. A cooler (10) for cooling a gaseous medium compressed in a compressor, the cooler comprising:

a housing (11);

a heat exchanger (12) positioned in the housing (11), the heat exchanger (12) having an inlet portion (14) arranged at a flow inlet side of the heat exchanger (12), an outlet portion (16) arranged at a flow outlet side of the heat exchanger (12), and a plurality of tubes, through which plurality of tubes a coolant flows and about which plurality of tubes gaseous medium to be cooled circulates;

at least one inflow (13), through which at least one inflow (13) the medium to be cooled can be introduced into the housing (11) and fed to the inlet portion (14) of the heat exchanger (12);

at least one drain (15), through which at least one drain (15) cooled medium originating from the outlet portion (16) of the heat exchanger (12) can be discharged out of the housing (11); and a plurality of plate-like flow homogenization elements (18, 19) positioned in the housing (11) at a position upstream of the inlet portion (14) of the heat exchanger (12), seen in a flow direction of the medium to be cooled, wherein the plurality of perforated, plate-like flow homogenization elements (18, 19) is subdivided into a plurality of segments of different porosity, wherein in the housing (11) at least two of the plurality of perforated, plate-like flow homogenization elements (18, 19) are positioned at an angle profile to one another such that a first, upper one of the plurality of flow homogenization elements (18) extends in the flow direction of the medium to be cooled through the heat exchanger (12), and a second, lower one of the plurality of flow homogenization elements (19) extends at an incline to the flow direction of the medium to be cooled through the heat exchanger (12), wherein the first, upper flow homogenization element (18) is arranged below an upper edge (20) of the heat exchanger (12) at a first spacing and the first, upper flow homogenization element (18) and the second, lower flow homogenization element (19) are each arranged at a second spacing from the inlet portion (14) of the heat exchanger (12), and wherein the second, lower flow homogenization element (19) is subdivided into a plurality of segments of different porosity, wherein the segments of different porosity of the second, lower flow homogenization element (19) are positioned on top of one another such segments that are adjacent to the first, upper flow homogenization element (18) have a relatively high porosity and segments that are distal to the first, upper flow homogenization element (18) have a relatively low porosity, the porosity decreasing with increased distance from the first, upper flow homogenization element (18).

8. A cooler (10) for cooling a gaseous medium compressed in a compressor, the cooler comprising:

a housing (11);

a heat exchanger (12) positioned in the housing (11), the heat exchanger (12) having an inlet portion (14) arranged at a flow inlet side of the heat exchanger (12), an outlet portion (16) arranged at a flow outlet side of the heat exchanger (12), and a plurality of tubes, through which plurality of tubes a coolant flows and about which plurality of tubes gaseous medium to be cooled circulates;

at least one inflow (13), through which at least one inflow (13) the medium to be cooled can be introduced into the housing (11) and fed to the inlet portion (14) of the heat exchanger (12);

at least one drain (15), through which at least one drain (15) cooled medium originating from the outlet portion (16) of the heat exchanger (12) can be discharged out of the housing (11); and a plurality of plate-like flow homogenization elements (22, 23, 24) positioned in the housing (11) at a position upstream of the inlet portion (14) of the heat exchanger (12), seen in a flow direction of the medium to be cooled, the plurality of plate-like flow homogenization elements (22, 23, 24) comprising:

a first, perforated, plate-like upper flow homogenization element (22) extending in the flow direction of the medium to be cooled through the heat exchanger (12);

a second, perforated, plate-like lower flow homogenization element (23), extending in the flow direction of the medium to be cooled through the heat exchanger (12); and a third, perforated, plate-like middle flow homogenization element (24), extending between the upper and lower flow homogenization elements (22, 23) perpendicularly to the flow direction of the medium to be cooled through the heat exchanger (12).

9. The cooler according to claim 8, wherein the first, upper flow homogenization element (22) is arranged below an upper edge (20) of the heat exchanger (12) at a first spacing, and the first, upper flow homogenization element (22), the second, lower flow homogenization element (23) and the third, middle flow homogenization element (24) are each arranged at a second spacing from the inlet portion (14) of the heat exchanger (12).

10. The cooler according to claim 9, wherein the upper, lower and middle flow homogenization elements (22, 23, 24) are each subdivided into a plurality of segments of different porosity.

* * * * *